United States Patent [19]

Hines

[11] Patent Number: 4,467,241

[45] Date of Patent: Aug. 21, 1984

[54] CRT WITH MAGNETIC SHIELD

[75] Inventor: William A. Hines, Lancaster, Ohio

[73] Assignee: Owens-Illinois, Inc., Toledo, Ohio

[21] Appl. No.: 342,994

[22] Filed: Jan. 20, 1982

Related U.S. Application Data

[62] Division of Ser. No. 080,855, Oct. 1, 1979, abandoned.

[51] Int. Cl.[3] ..... H01J 29/02

[52] U.S. Cl. ..... 313/402; 313/406; 313/479; 313/242

[58] Field of Search ..... 313/402, 403, 406, 407, 313/479, 482, 242

[56] References Cited

U.S. PATENT DOCUMENTS

| | | | |
|---|---|---|---|
| 2,951,167 | 8/1960 | Kegg et al. | 313/406 |
| 3,735,179 | 5/1973 | Kaplan | 313/406 X |
| 3,821,583 | 6/1974 | Steiner | 313/407 |
| 3,971,490 | 7/1976 | Conger | 313/406 X |
| 4,229,675 | 10/1980 | Matsuki et al. | 313/479 X |

FOREIGN PATENT DOCUMENTS

| | | | |
|---|---|---|---|
| 54-858 | 1/1979 | Japan | 313/479 |

*Primary Examiner*—Eugene R. LaRoche
*Assistant Examiner*—Vincent De Luca
*Attorney, Agent, or Firm*—David R. Birchall; Myron E. Click

[57] ABSTRACT

A glass funnel for a cathode ray tube is formed by centrifically casting it in a rotating mold. Integrally formed lugs are formed on the interior wall of the funnel. The lugs vary in geometry and are utilized to position and attach a magnetic shield to the funnel. The funnel and its attached magnetic shield forms a subassembly that is independent of the remainder of the cathode ray tube components.

A method is set forth for fabricating the funnel and the attached lugs by centrifugally spinning molten glass within a mold.

1 Claim, 8 Drawing Figures

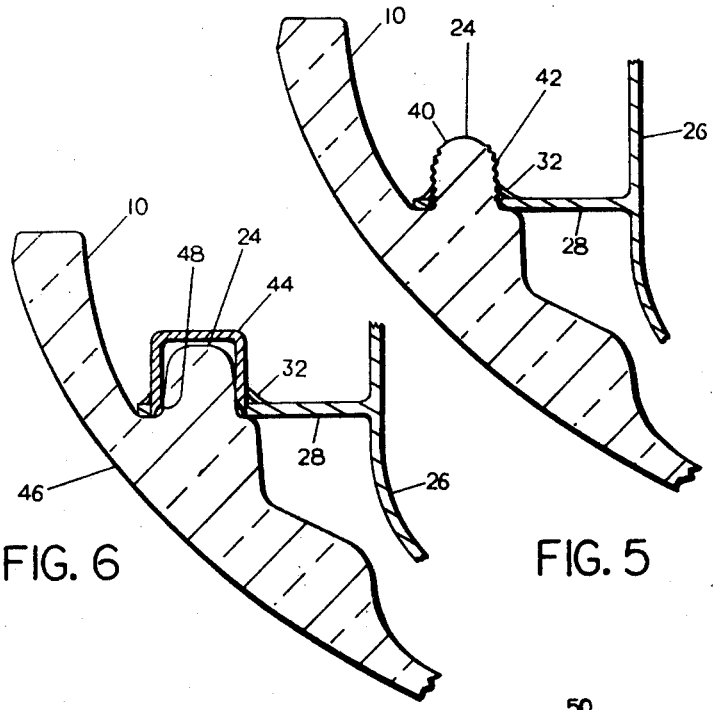
FIG. 5
FIG. 6
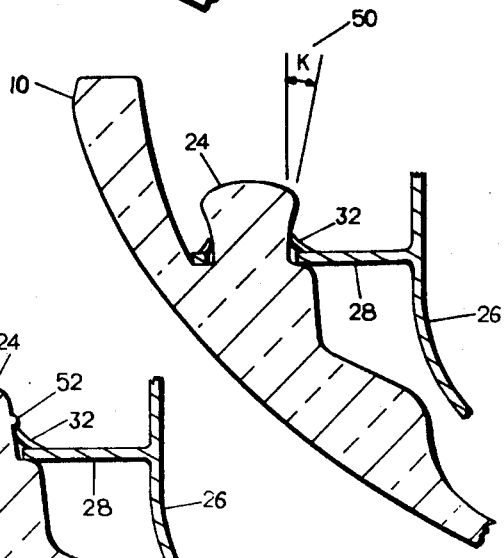
FIG. 7
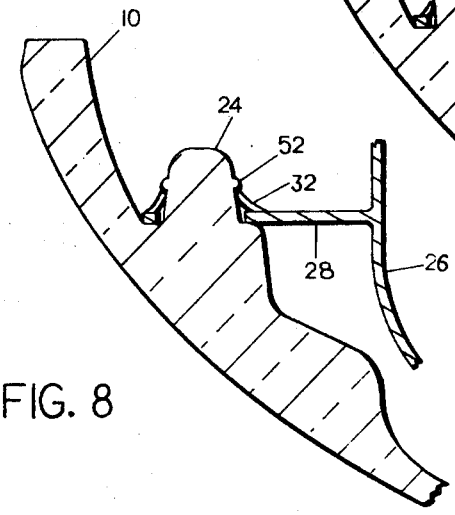
FIG. 8

CRT WITH MAGNETIC SHIELD

BACKGROUND OF THE INVENTION

This is a division of application Ser. No. 080,855 filed Oct. 1, 1979, now abandoned.

This invention relates to cathode ray tubes, and in particular, it relates to a cathode ray tube for use with the reception of color television. Specifically, the invention relates to an improvement in the mounting of a magnetic shield supported entirely by the funnel portion of the cathode ray tube.

It is well known that cathode ray tubes, utilized as receivers for color television, are provided with magnetic shields for eliminating the effects upon the cathode ray tubes because of terrestrial magnetism and other spurious magnetic fields caused by the electric circuitry of the television receiver or other nearby electrical devices. It is also known that the strategic positioning of the magnetic shield within the funnel portion of the cathode ray tube makes the shielding effect greater. The magnetic shield positioned within the CRT envelope is generally referred to as an "internal magnetic shield" and heretofore has been anchored in position by attachment to the shadow mask or its mounting points.

However, particularly in cathode ray tubes for color reception, the magnetic shield becomes cumbersome to handle, install and properly align when it is cantilevered from mounting points on or near the shadow mask which is generally in close proximity to the interior surface of the CRT faceplate.

Thus, it is desirable to fix the position of the magnetic shield and install it independently of the faceplate and its associated shadow mask.

DESCRIPTION OF THE PRIOR ART

The prior art shows and describes magnetic shields which are mounted internally of the cathode ray tube envelope or bulb. U.S. Pat. No. 3,821,583 issued June 28, 1974 shows a magnetic shield that is mounted from lugs that are an integral part of the CRT funnel. In this patent the lugs project radially inward and are positioned generally perpendicular to the longitudinal axis of the overall CRT. While this particular patent states the lugs may be an integral part of the funnel, there is no practical way of producing the integral lugs and remain within the cost demands of a highly competitive product.

Also shown in the prior art are attachment points positioned within the CRT funnel. Such attachment points, in the form of notches or grooves, are shown in U.S. Pat. No. 3,971,490 issued July 27, 1976. The attachment points shown in this patent facilitate the anchoring of the faceplate structure to the funnel portion of the CRT. The grooves so positioned and depicted in this patent can be fabricated by pressing the funnel in matched molds or else employing centrifugal forces and spinning the funnel to its desired configuration in a spinning mold.

Various integrally formed bosses have been manufactured in glass components for cathode ray tubes. An example of integrally formed bosses can be seen in U.S. Pat. No. 3,735,179 issued May 22, 1973. The bosses thus shown are used to position the shadow mask in proper alignment within the faceplate structure.

Integrally formed bosses or lugs for anchoring shadow masks within CRT faceplates are shown in U.S. Pat. No. 2,951,167 issued Aug. 30, 1960. The bosses were formed by matched metal molds utilized to press the hot deformable glass to the final shape.

SUMMARY OF THE INVENTION

The present invention relates to cathode ray tubes utilized for polychromatic or colored television reception. Specifically, the present invention relates to the fabrication of the funnel portion of the CRT bulb and the accommodation of a magnetic shield mounted internally of the funnel.

During the assembly of a CRT for colored television reception, the faceplate is generally pressed to final configuration and the outstanding edge of the faceplate flange is prepared for attachment to the funnel. Provisions such as internally positioned metallic studs are embedded within the faceplate flange for supporting the shadow mask assembly. Thus the faceplate and the shadow mask become a subassembly of the CRT.

The funnel portion of the CRT is manufactured by pressing hot deformable glass to the desired shape or else the funnel is formed by a centrifugal process where a quantity of hot deformable glass is positioned in the lower portion of a frusto-conical mold and the mold is rotated or spun to distribute the glass over the interior surface of the mold.

The spinning of a funnel provides a closely held exterior contour, however, the funnel interior surface is somewhat less precise in that variations in the mass of the glass contribute to thickness variations as does the angular velocity at which the mold rotates, as well as the temperature of the glass.

The top or large edge of the funnel is ground or formed so that it matches the faceplate flange edge. The faceplate and funnel edges are then positioned in abutting relationship with one another and a sealing or solder glass is used to adhere the parts together to form the bulb or large portion of the CRT.

During the formation of the funnel by the centrifugal or rotating mold method, the hot deformable glass distributes itself over the interior surface of the mold. The extra glass moves toward the larger or outer edge of the funnel. When the so-called rectangular CRT funnels are manufactured, the extra glass has a tendency to move into the top outer corners of the funnel. It has now been discovered that this extra glass can be utilized to produce an acceptable boss or lug for the mounting of a magnetic shield. The lugs are aligned with the longitudinal axis of the CRT and are formed so that extra machining or grinding is not necessary. The lugs so produced accept the attachment points of a magnetic shield, thus permitting a subassembly to be created. The previously pointed out subassembly of the faceplate and its accompanying shadow mask can then be mated to the funnel subassembly to create a CRT bulb.

BRIEF DESCRIPTION OF THE DRAWINGS

The present invention will become more readily apparent from the following detailed description taken in conjunction with the accompanying drawings in which:

FIG. 5 is a fragmental sectional view showing a variation in the mounting lug surface;

FIG. 6 is a fragmental sectional view showing yet another lug mounting concept;

FIG. 7 is a sectional view similar to FIGS. 5 and 6 which shows another embodiment of the mounting lug;

FIG. 8 is another sectional view showing a further embodiment in the mounting lug.

DESCRIPTION OF THE PREFERRED EMBODIMENT

Figure 1:
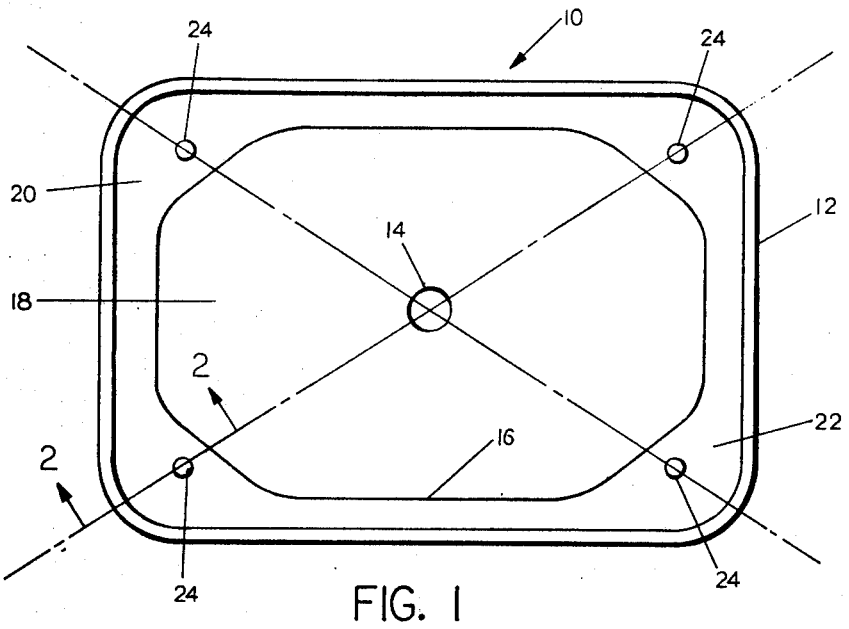
FIG. 1 is a top plan view of the funnel portion of a cathode ray tube.

Referring now to the drawings, and in particular to FIG. 1, there is illustrated the top plan view of a CRT funnel. The funnel is shown generally at numeral 10 and the view is such that the observer is looking down into the funnel. The funnel 10 is of frusto pyramidal configuration common to the so-called rectangular cathode ray tubes. The top edge 12 is of uniform thickness and is adapted to mate with the corresponding flange of a faceplate which is of equal thickness. The bottom or small end 14 is coupled with a neck tube which houses the electron guns and associated electrical parts which are not herein shown. The funnel 10 depicted in FIG. 1 is one that has been formed by the centrifugal spinning technique, consequently, there is shown a settle wave or demarcation line 16 between the rather thin lower area 18 of the funnel 10 and the thicker or upper area 20 of the funnel. Since the corner areas 22 are positioned farthest from the axis of spin of the mold in which funnel 10 is spun, more hot glass has a tendency to accumulate or build up in the corners 22. The buildup of molten glass in corners 22 can be utilized to achieve one of the main objectives of the present invention, that is, the satisfactory anchoring of a magnetic shield within a CRT. Typical magnetic shield mounting lugs 24 are shown in all four corners of funnel 10.

Figure 2:
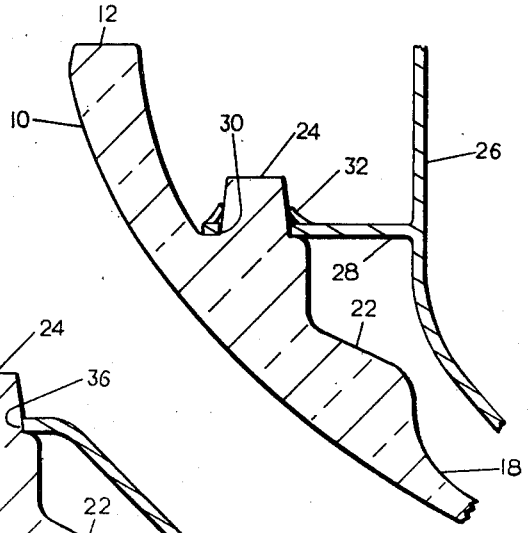
FIG. 2 is a fragmental sectional view taken along the lines 2—2 of FIG. 1.

FIG. 2 is a sectional view taken along lines 2—2 of FIG. 1 with an extra fragmentary portion of a magnetic shield 26 attached thereto. The magnetic shield 26 is not shown in FIG. 1. The magnetic shield 26 has appropriate clip mounting strips 28 attached to the main body portion thereof. The mounting strips 28 each contain an aperture 30 of a size sufficient to fit over the sidewall of mounting lugs 24. The mounting strips 28 are kept in firm contact with the base of the mounting lug 24 by means of a spring metal fastener 32 which fits over lug 24 and firmly grasps the sidewall thereof.

Figure 3:
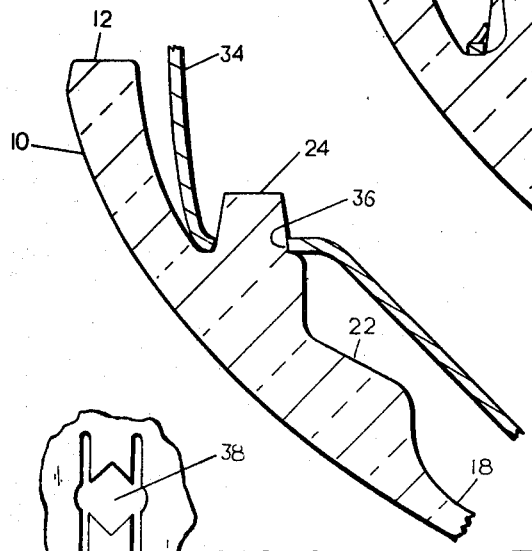
FIG. 3 is a view similar to FIG. 2 which shows a modification of the magnetic shield mounting.

FIG. 3 is a modification of the funnel and magnetic shield assembly shown in FIG. 2. Instead of the mounting strips 28 utilized in the embodiment of FIG. 2, an aperture 36 is placed directly in the main structure of the modified magnetic shield 34. The spring metal fastener shown in FIG. 2 may be employed to immobilize the modified magnetic shield 34 or the fastening means about to be described can be utilized.

Figure 4:
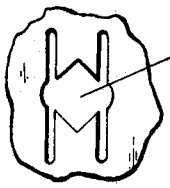
FIG. 4 is a broken-away view which shows the magnetic shield fastener of FIG. 3.

FIG. 4 shows a broken away fastener 38 which is an integral part of the modified magnetic shield 34. Thus it is conceivable that a magnetic shield of one-piece construction could be employed with the present invention.

During the formation of the funnel 10 and the integrally attached lugs 24, it has been discovered that satisfactory lugs can be formed from the extra glass material that heretofore existed naturally in the corner areas 22. Consequently, it is not necessary to increase the weight and volume of the glass charge in order to provide adequate glass for lugs 24. The funnel 10 is formed by the so-called spin against a ring technique where a ring of metal is placed against the outer peripheral edge of the centrifugal mold. As the mold rotates, the molten glass climbs the walls of the mold and ultimately comes to rest against the mold ring, thus forming a top edge 12 that requires little or no finishing before being coupled to the CRT faceplate. To provide lugs 24 in each of the corner areas 22, proper indentations or cavities are placed in the mold ring to receive the molten glass as it is distributed throughout the mold by the centrifugal force attributable to the spinning of the mold.

Thus through the present invention it is possible to enhance the assemblying of a CRT by forming two subassemblies, that is, the faceplate-shadow mask assembly and the funnel-magnetic shield assembly. The advantages of this system become readily apparent when it is realized that during the creation of a CRT for colored television the faceplate and associated shadow mask must be coupled with the funnel at least three times as the various phosphor coatings are applied to the faceplate interior.

FIG. 5 shows a variation of lug 24 in that the top edge 40 has been rounded so that lug 24 is more receptive for the positioning of magnetic shield 26. Also, the exterior of lug 24 has been knurled or roughened as shown at 42. The knurling of the exterior surface 42 provides a more positive grip for the spring metal fastener 32. Because of the electrical nature of a CRT, there must be assurances that fasteners such as 32 do not loosen to the extent they are free to move about the interior of the CRT. Such indiscriminate movement of a fastener within a CRT would rapidly lead to a malfunction of the CRT.

FIG. 6 shows an additional embodiment of the present invention. The lug 24 may be rounded as shown in FIG. 5 or it can be planar on top as shown in FIGS. 2 and 3. A metal cap 44 is positioned over lug 24 such that its bottom edge 46 rests upon the glass of funnel 10 at the base of lug 24. To firmly attach metal cap 44 to lug 24, a low temperature sealing or solder glass 48 is placed at the bottom edge 46 of cap 44. The sealing glass can be positioned before or after metal cap 44 is placed over lug 24. Subsequent firing or heating can be employed to reduce the sealing glass to its molten state, thus wetting the surfaces of both funnel 10 and the bottom edge 46 of cap 44. By utilizing metal cap 44, there are assurances that the use of a metal fastener such as 32 would not inadvertently cause small glass chips to be spalled from the side of lug 24 during or after installation of the magnetic shield 26.

FIG. 7 shows another embodiment of the invention wherein the lug 24 is not only rounded at the top, but also has a reverse taper 50 depicted by the angle K as shown on the drawing. The enlargement of lug 24 toward its free end provides extra assurances that the spring metal clip 32 will not advertently work loose from its installed position either during shipment of the CRT or actual use in a television receiver set.

FIG. 8 shows a variation of a positive retaining means, the spring metal clip 32. A ring of glass 52 is formed on the sidewall of lug 24. The glass ring 52 is positioned so that the extended fingers of clip 32 will come to final installed position just beneath ring 52. Once again, this embodiment provides a way of preventing the inadvertent movement of a clip 32 from its installed position.

Other modifications may be made to this invention without departing from the scope of the invention.

What is claimed is:

1. In a funnel assembly for a color television picture tube comprising an elongate hollow glass body of generally frusto-pyramidal configuration which is adapted to receive a neck tube at the smaller end and a faceplate at the larger end, and a magnetic shield supported from and positioned within the interior of said funnel, the improvement comprising a plurality of integrally formed elongate cantilevered lugs positioned in each of four reentrant corners of said funnel, said lugs being tapered and each having a free end and a base having a longitudinal axis in parallel alignment with the longitudinal axis of said funnel, said lugs having their free ends most remote from the funnel end adapted to receive said neck tube, said magnetic shield coacting with said funnel lugs by means of apertured mounting strips attached to said magnetic shield, a plurality of fasteners or spring tabs positioned over said lugs to bias said magnetic shield against said lugs to immobilize the magnetic shield with respect to said funnel.

* * * * *